United States Patent [19]

Paul et al.

[11] Patent Number: 4,598,688

[45] Date of Patent: Jul. 8, 1986

[54] ARROW REST FOR BOWS

[76] Inventors: Lawrence L. Paul, 206 Knotty Circle Dr.; Robert L. Glaspie, 700 N. Columbus, both of West Liberty, Iowa 52776

[21] Appl. No.: 429,301

[22] Filed: Sep. 30, 1982

[51] Int. Cl.[3] ..... F41B 5/00

[52] U.S. Cl. ..... 124/41 A

[58] Field of Search ..... 124/41 A, 24 R, 88

[56] References Cited

U.S. PATENT DOCUMENTS 2,998,811 9/1961 Sackmann ..... 124/24 R 3,108,584 10/1963 Coe ..... 124/24 R 3,406,675 10/1968 Fredrickson ..... 124/24 R 3,504,659 4/1970 Babington ..... 124/41 A X 4,332,232 6/1982 Troncoso ..... 124/41 A X

*Primary Examiner*—Richard J. Apley

*Assistant Examiner*—William R. Browne

*Attorney, Agent, or Firm*—James C. Nemmers

[57] ABSTRACT

An arrow rest for hunting and target bows. The rest employs a pair of rollers mounted on each side of a groove in a carrier that is removably secured to the back of the riser handle of the bow. The carrier is fully adjustable, fits either right or left hand bows of all types and can be used with almost all arrow sizes both target and hunting.

8 Claims, 3 Drawing Figures

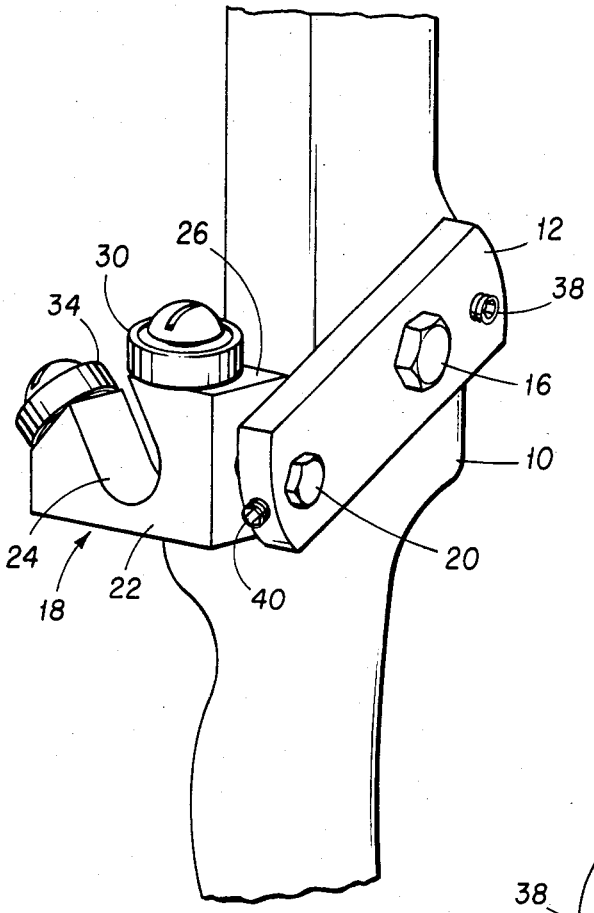
FIG 1
FIG 2
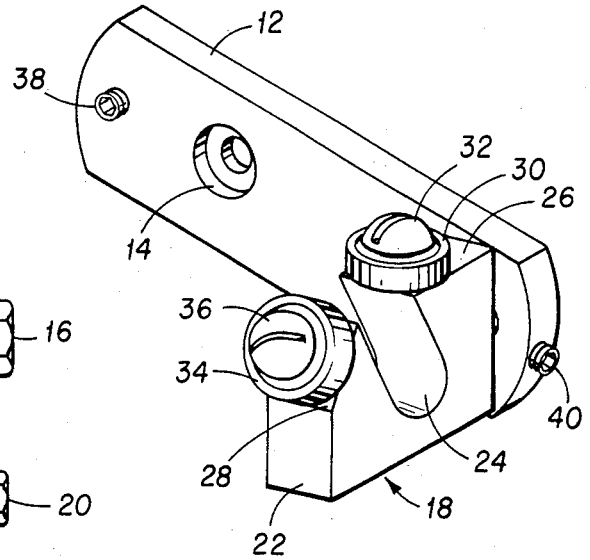
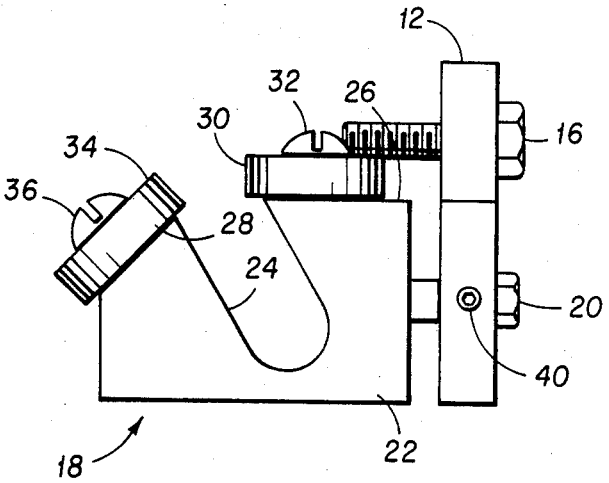
FIG 3

ARROW REST FOR BOWS

BACKGROUND OF THE INVENTION

In recent years, the popularity of the bow and arrow have increased dramatically both for use in hunting and in target competition. As more and more individuals become increasingly proficient with the use of the bow and arrow, they demand better equipment that will produce more accuracy. There have therefore been developed many accessories for bows which accessories are designed to meet the need and demands of almost every user. Although there are many arrow rests known and used, they all have disadvantages. The person who seeks the utmost in accuracy in shooting, and who wishes complete quiet and maximum velocity in hunting will not find anywhere an arrow rest that meets his or her demands. For example, most prior art arrow rests create an undesirable amount of friction between the rest and the arrow thus decreasing its potential maximum velocity. Also, most known arrow rests will cause the arrow to flutter as the vanes deflect when they pass the rest. This, of course, decreases accuracy. Also, in hunting live game, complete quiet is necessary or the game may move out of the flight of the arrow before it reaches its mark.

There is therefore a need for an improved arrow rest which is completely quiet, will decrease vane deflection and will create a minimum of friction with the arrow as it passes over the rest. There is also a need for such an arrow rest which can be easily installed on bows of all types and which can be used for both right or left bows without modification of the arrow rest or the bow.

SUMMARY OF THE INVENTION

The improved arrow rest of the invention employs a universal mounting bracket that is adjustably attached to a carrier that provides the arrow rest. The carrier has a groove at the proper angle to permit passage of the vanes of the arrow, and on each side of the groove is a low friction roller. The rollers are mounted at an angle that will permit use of arrows of various sizes without any modification but which will support and accurately guide an arrow of any size. The design of the mounting bracket and carrier are such that it can be fitted to either right or left bows with no modification.

BRIEF DESCRIPTION OF THE DRAWINGS

FIG. 1 is a perspective view of the arrow rest of the invention showing the rest mounted on a bow for right-hand shooters;

FIG. 2 is a perspective view of the arrow rest detached from the bow; and

FIG. 3 is an end elevation view of the arrow rest.

DESCRIPTION OF A PREFERRED EMBODIMENT OF THE INVENTION

In FIG. 1, the arrow rest of the invention is shown mounted on the back of the riser handle portion 10 of a bow. The arrow rest is shown mounted for use by a righthand shooter, but as will be described hereinafter, the arrow rest of the invention can be mounted for use by lefthand shooters without any modification of the rest.

The arrow rest of the invention has a mounting member 12 that has a counter sunk opening 14 formed in it near one end. Opening 14 receives a bolt 16 that removably secures the arrow rest to the bow. As is well known, most bows have a predrilled and threaded opening (not shown) in the riser handle for the purpose of mounting accessories such as an arrow rest to the bow. The bolt 16 of course will have the same threads as the prethreaded opening in the riser handle 10.

The mounting member 12 has secured to it at the end opposite opening 14 a carrier indicated generally by the reference numeral 18. Carrier 18 is attached to mounting member 12 by a suitable bolt 20 which extends into a threaded opening in the body 22 of carrier 18.

As best seen in FIG. 3, the body 22 has a U-shaped groove 24 formed in it that provides an opening at the top of the body 22. The groove 24 is at an angle of 30 degrees from the vertical so as to accommodate the vane of an arrow. The groove 24 thus forms a divided top surface on the body 22 with a surface 26 closest to the mounting member 12 being horizontal and the outer surface 28 being at an angle. Secured to the surface 26 is a roller 30 held in place on body 22 by a bolt 32 so that roller 30 rotates about a vertical axis. Similarly, outer surface 28 has a roller 34 affixed to it by bolt 36 so that roller 34 also rotates about an axis which axis is at an angle of between 45 and 50 degrees to the axis of rotation of roller 30. We have found that if this axis is set at 47 degrees 53 minutes the device will operate at its optimum. Preferably, rollers 30 and 34 are of the lowest friction possible, and we have found that roller bearings appear to work the best.

In mounting the arrow rest to a bow, and assuming it is to be mounted for a righthand shooter as shown in FIG. 1, the mounting member 12 is secured to the riser handle 10 by threading bolt 16 into the prethreaded opening in riser handle 10. Of course, if no such opening is provided, one will have to be drilled in riser handle 10. Then, with bolt 20 slightly loose, the carrier 18 is positioned in the proper place and so that surface 26 is level or at a right angle to the vertical plane of the bow. Bolts 16 and 20 are then tightened, and the selected position of the arrow rest is locked in place by use of set screws 38 and 40. The arrow rest is then ready for use.

If the arrow rest is to be mounted on a bow for left-hand shooters, it can be easily moved from the position shown in FIG. 1 to the opposite side of the riser handle 10 by loosening bolt 20 and removing bolt 16. The mounting member 12 is then turned 180 degrees or inverted and the bolt 16 reinserted on the opposite side of the riser handle. Since the carrier 18 will be in an upside down position, it is then rotated and properly positioned until the surface 26 is horizontal. The bolt 20 is then tightened and set screws 38 and 40 tightened to lock the rest in the selected position. Thus, the same rest can be used for either right or left bows without any modification or without even disassembling the components.

The use of the rest of the invention should be evident to persons skilled in the art from the above description. However, when the user is ready to shoot, the shank of the arrow (not shown) will be rested between the two rollers 30 and 34. The angle and spacing of rollers 30 and 34 are such that the arrow cannot fall through into the groove 24. The shooter then aims and shoots in the normal manner. As the arrow is released, the shaft will of course rapidly move along between the rollers 30 and 34 and one of the vanes of the arrow will pass through groove 24. Thus, there will be no deflection of the arrow caused by the rest of the invention, and it is completely quiet. Also, the rollers 30 and 34 provide a guide and rest to prevent the arrow from falling off and thus eliminates the need for a separate arrow holder. Since the carrier 18 is mounted on the back side of the riser handle 10, use of the arrow rest of the invention practically eliminates overdraw and allows the use of one and a half inch shorter arrows than draw length arrows normally used for target competition. We have also found that the arrow rest of the invention will permit shooting all arrows in sizes from 1816 through 2219 including metric sizes without in any way retuning the bow or the rest. Use of the arrow rest of the invention also does not interfere in any way with use of the bow in any manner.

Having thus described the invention in connection with the preferred embodiment thereof, it will be evident to those skilled in the art that various revisions and modifications can be made to the preferred embodiment without departing from the spirit and scope of the invention. It is our invention however that all such revisions and modifications as are obvious to those skilled in the art will be included within the scope of the following claims.

What is claimed is:

1. An arrow rest for use in connection with a bow, said arrow rest comprising a mounting member having a forward end and a rear end for mounting the arrow rest on a bow, a fastening member for removably securing the mounting member to a bow, said mounting member having an opening extending through it to receive the fastening member and to secure the mounting member to a bow at a selected angle, a carrier pivotally connected to the mounting member at its rearward end, means for holding the carrier in a selected position to the rear of a bow when it is turned on its pivotal connection which said carrier to the mounting member, the carrier having a groove extending through the top of the carrier at an angle to permit the passage of the vane of an arrow through the groove, and a low friction roller positioned on each side of the groove and on each side of the line of flight of an arrow, the axis of rotation of one roller being a vertical axis, the axis of rotation of the other roller being at an angle of 45 to 50 degrees from the axis of rotation of said one the roller.

2. The arrow rest of claim 1 in which the spacing of the rollers is such to prevent an arrow from dropping into the groove.

3. The arrow rest of claim 2 in which the pivotal connection between the carrier and mounting member is a threaded member, and the means for holding the carrier in a selected position when turned relative to the pivotal connection is a set screw.

4. An arrow rest for use in connection with a bow, said arrow rest comprising a mounting member having a forward end and a rear end for mounting the arrow rest on a bow, a fastening member for removably securing the mounting member to a bow, said mounting member having an opening extending through it to receive the fastening member and to secure the mounting member to a bow at a selected angle, a carrier pivotally connected to the mounting member at its rearward end, means for holding the carrier in a selected position to the rear of a bow when it is turned on its pivotal connection to the mounting member, the carrier having a groove extending through the top of the carrier along the line of flight of an arrow to permit the passage of the vane of an arrow through the groove, and a low-friction rotatable guide member positioned on each side of the groove so as to engage and support an arrow laterally and guide an arrow during its initial flight.

5. The arrow rest of claim 4 in which the guide members are low friciton rollers.

6. The arrow rest of claim 5 in which the axis of rotation of one roller has a vertical axis, the axis of rotation of the other roller is at an angle of 45 to 50 degrees from the axis of rotation of said one roller.

7. The arrow rest of claim 6 in which the pivotal connection between the carrier and mounting member is a threaded member, and the means for holding the carrier in a selected position when turned relative to the pivotal connection is a set screw.

8. The arrow rest of claim 4 in which the carrier and mounting member are fully rotatable about their respective pivotal connections, so that the mounting member can be rotated relative to the carrier until its upper portion on one side of a bow becomes its lower portion on the other side of a bow, the carrier and mounting member then being rotated as a unit in a horizontal plane approximately 180° to be in a position to be fastened to the other side of a bow without disconnecting the mounting member and carrier.

* * * * *